US007320766B2

(12) United States Patent
Rao

(10) Patent No.: US 7,320,766 B2
(45) Date of Patent: Jan. 22, 2008

(54) OVERDYEABLE PIGMENTED POLYMERIC FIBER AND YARNS AND ARTICLES MADE THEREFROM

(75) Inventor: Sundar Mohan Rao, Chattanooga, TN (US)

(73) Assignee: INVISTA North America S.ar.l., Wilmington, DE (US)

( * ) Notice: Subject to any disclaimer, the term of this patent is extended or adjusted under 35 U.S.C. 154(b) by 8 days.

(21) Appl. No.: 10/786,685

(22) Filed: Feb. 25, 2004

(65) Prior Publication Data

US 2005/0183218 A1 Aug. 25, 2005

(51) Int. Cl.
*D01F 1/00* (2006.01)
*D01F 1/02* (2006.01)
*D01F 1/04* (2006.01)

(52) U.S. Cl. ..... 264/78; 8/404; 8/445; 8/550; 8/618; 8/636; 8/637.1; 8/924

(58) Field of Classification Search ..... 8/494, 8/495, 489, 637.1, 405, 550, 404, 445, 618, 8/636, 924; 264/78
See application file for complete search history.

(56) References Cited

U.S. PATENT DOCUMENTS 4,087,494 A * 5/1978 Reinehr et al. ..... 264/78
5,066,308 A 11/1991 Yeh et al.
5,108,684 A 4/1992 Anton et al.
5,445,653 A 8/1995 Hixson et al.
5,562,871 A 10/1996 Hoyt et al.
5,756,020 A * 5/1998 Locke et al. ..... 264/40.7
5,830,572 A 11/1998 Anton et al.
5,908,663 A * 6/1999 Wang et al. ..... 427/322

* cited by examiner

*Primary Examiner*—Lorna M. Douyon
*Assistant Examiner*—Tri Nguyen

(57) ABSTRACT

Dyed yarns typically have inferior color fastness compared with pigmented yarns. However, dyeing offers a virtually infinite selection of colors, flexibility and more uniformity than constructions of pigmented yarns in residential carpet and other yarn applications, such as apparel. It has been found that relatively small amounts of pigment (10 to 1000 ppm) incorporated into polymeric fibers, and particularly nylon fibers used in carpets, creates lightly pigmented yarns which, when overdyed, are highly uniform and have a higher degree of apparent dye light fastness compared to normal dyed yarns. This effect is observable for both anionic and cationic polyamide polymers, and dyeing of these slightly pigmented yarns can be conducted to produce yarns of almost any color of greater depth than the base yarn.

9 Claims, No Drawings

OVERDYEABLE PIGMENTED POLYMERIC FIBER AND YARNS AND ARTICLES MADE THEREFROM

FIELD OF THE INVENTION

This invention relates to highly uniform overdyed articles made from polymer, and particularly polyamide, fibers and yarns prepared with low levels of incorporated color pigment. The fibers and articles display a higher degree of apparent dye light fastness compared to normal dyed fibers. The process of the subject invention is specifically applicable to fibers and yarns made from normal dyeable polyamide and other polymers, and can produce almost any shade of color in a fabric which is of greater depth than the base color of the initial pigmented fiber and yarns. The invention is particularly of interest in the area of carpeting.

BACKGROUND OF THE INVENTION

Carpets made from polymer yarns, and particularly polyamide yarns such as nylon, are popular floor coverings for residential and commercial applications. Such carpets are relatively inexpensive and have a desirable combination of qualities, such as durability, aesthetics, comfort, safety, warmth, and quietness. Further, such carpets are available in a wide variety of colors, patterns, and textures. Polymer, and particularly polyamide, yarns are preferred for carpeting because they can be dyed easily with acid or other types of dyes. While dyeing is the most common method to obtain various carpet colors, color fastness is an issue. Ultraviolet light degrades the appearance of dyed carpet. Pre-metallized dyes can provide dyed articles and carpets having better light fastness, but these dyes are expensive. Additionally, their large molecular structure tends to make them more sensitive to small differences in the yarn, so they tend to dye somewhat less evenly than standard small molecule "work-horse" acid dyes. Pre-metallized dyes are also somewhat less environmentally acceptable than non-metallic dyes, so they can present waste disposal problems.

Colored pigments have long been incorporated into the fibers comprising polyamide and other polymer yarns to create durable colored carpets which maintain their color in spite of wear because, unlike most dyed fibers, the color is incorporated throughout the fiber.

For example, as described in U.S. Pat. Nos. 5,108,684 and 5,830,572, both to Anton et. al. ("Anton"), the specifications of which are hereby incorporated by reference in a manner consistent with this disclosure, the white pigment $TiO_2$ is added in small quantities to nylon yarn as a delustering agent for nylon. Additionally, colored pigments may be added to the molten copolymer prior to spinning and drawing to improve the resistance of the yarn to degrading and fading in ultraviolet light. In Anton, color pigment concentrations added to the molten copolymer ranged from about 5900 ppm to about 8100 ppm. Anton discloses how most colored pigments cause difficulties during mixing into the copolymer and also during spinning and drawing operations. In Anton, materials which confer cationic dyeability on the polymer, such as aromatic sulfonates or their alkali metal salts, are also incorporated into the yarn prior to spinning to render the polymer resistant to acid dyes. Yarns made according to the invention of Anton are suitable as stain-resistant, pigmented nylon resins.

U.S. Pat. No. 5,562,871 to Hoyt et. al. ("Hoyt"), the disclosure of which is hereby incorporated by reference in a manner consistent with this disclosure, discloses incorporating color pigments along with $SO_3H$ groups or salts thereof that resist anionic dyes. Fibers made according to the invention of Hoyt provide stain resistant polyamide fibers. Hoyt discloses examples containing about 500 ppm carbon black to provide a lightly pigmented grey color to the yarn.

U.S. Pat. No. 5,445,653 to Hixson et. al. ("Hixson"), the disclosure of which is hereby incorporated by reference in a manner consistent with this disclosure, discloses a method of dyeing nylon, particularly cationic dyeable Type 6 and 66 nylon and light dyeable Type 66 nylon so that the dyed fiber will resist taking on further dye. Yarns made according to the invention of Hixson have a high degree of wash and bleed fastness. Hixson notes that yarns made by incorporating color pigment into the yarn results in the availability of only a few solid colors, limiting design creation.

U.S. Pat. No. 5,066,308 to Yeh et., al. ("Yeh"), the disclosure of which is hereby incorporated by reference in a manner consistent with this disclosure, discloses the addition of color pigment to yarns for preparation of patterned textile fabrics such as carpeting. Sufficient pigment is incorporated into the nylon prior to extrusion during the fiber melt spinning process such that the pigmented yarn can be detected visually to provide a good identifier to distinguish it from other yarns during the manufacturing process of the patterned fabrics.

Such color pigmented fibers enjoy permanent coloration which is not removed by washing, and are more resistant to degrading and fading under ultraviolet light and exhibit improved resistance to chemicals and nitrous oxide fumes than dyed fibers. However, the process of adding pigments to fibers tends to be more expensive than dyeing, especially at the high pigment concentrations required for deep colors. While pigmented fiber offers color fastness advantages, the number of colors required to satisfy customer preferences in the market place is huge and the cost of manufacture and inventory maintenance increases dramatically as the number of available colors increases. Therefore, pigmented fibers of the prior art are not well suited for use in efficiently producing a wide variety of substantially uniform color carpets.

One objective of the invention therefore is to provide a carpet or other overdyed article which enjoys the superior durability of pigmented polymer fiber, such as polyamide (e.g., nylon) fiber, along with the quality of appearance, color, dye depth, and ease of manufacture that dyeing processes yield today.

Another objective of the invention is to develop a new method whereby substantially uniform color polymer-based yarns and articles, such as polyamide (e.g., nylon) carpets, can be overdyed easily with "work-horse" acid dyes, but at the same time provide improved color and dye light fastness properties similar to that provided in articles manufactured with pigmented fibers.

SUMMARY OF THE INVENTION

The invention provides a method of producing overdyed articles, such as carpet, from yarns made from polymer-based fibers using "work-horse" acid dyes while improving color and dye light fastness. The method comprises adding relatively low amounts of total color pigment (10 to 1000 ppm) to a polymer or polymer blend and preparing the color pigmented fibers using conventional extrusion, spinning and drawing processes known today. Articles may be manufactured from the lightly pigmented yarns and then overdyed. For example, a tufted fabric may be manufactured from the lightly pigmented yarn, which then may be used to manufacture carpet, which may then be overdyed to a substantially uniform color.

Articles prepared from the lightly pigmented yarns that are overdyed are highly uniform and have a surprisingly higher degree of apparent dye light fastness compared to normal overdyed articles having no color pigment. Preferably, color pigments selected from at least two of the three color families of the trichromatic dye color system are incorporated into the color pigmented fibers. Preferably, the color pigmented fibers and yarns made therefrom have an L* rating of about 70 to about 94. Black pigment may be optionally added to the pigmented fiber to further reduce the L* value.

Also provided is a method of producing overdyed yarns from polymer-based fibers using "work-horse" acid dyes while improving color and dye light fastness by adding relatively low amounts of total color pigment (10 to 1000 ppm) to a polymer or polymer blend and preparing the color pigmented fibers using conventional extrusion, spinning and drawing processes known today. Preferably, color pigments selected from at least two of the three color families of the trichromatic dye color system are incorporated into the pigmented fibers. Fibers made with such low level of color pigment preferably have an L* value of about 70 to about 94. Black pigment may be optionally added to the pigmented fiber to further reduce the L* value. Substantially uniform colored articles made from the overdyed yarns are also disclosed.

Overdyeing of these lightly pigmented articles and yarns can be conducted to achieve almost any color of greater depth than the base pigmented fiber or yarn, according to the invention. The overdye color is not limited to the pigment colors or trichromatic color families in the fibers, further increasing the versatility of the fibers and yarns made according to the invention.

This effect of improved light fastness is observable for both anionic and cationic polyamides and blends and copolymers. It is also believed that similar effects will be observed for other polymer fibers, such as those made from polylactic acid and blends and copolymers thereof.

DETAILED DESCRIPTION OF THE INVENTION

The process of the subject invention comprises spinning color pigmented polymer fibers, or filaments, having low (10-1000 ppm) color pigment concentrations by weight of the filament, preferably about 25 to about 600 ppm, forming substantially homogenous, lightly pigmented yarns from the color pigmented fibers, and fabricating fabrics from the lightly pigmented yarns for use in articles such as carpets. The lightly pigmented fibers, and yarns made from those fibers, have an L* rating from about 70 to about 94, preferably from about 84 to about 90. If the fiber also contains non-color pigment $TiO_2$, the L* value could be as high as 94.

Articles, such as carpets or apparel, may be prepared from the yarn and then overdyed, preferably using conventional "work horse" acid dyes, in order to form a desired substantially uniform article of a darker color than the color pigmented fiber and yarn. Alternatively, yarn comprising the color pigmented fibers can be overdyed before preparing the article to prepare overdyed yarn. Yarn dye processes well known in the industry such as skein dyeing and space dyeing can be used to overdye the yarn. Such overdyed yarn can be used to make the desired substantially highly uniform articles, including carpets and apparel.

The resulting articles display a significant improvement in light fastness, as measured by Xenon exposure, compared to articles prepared by dyeing a white yarn to substantially the same color. The process of the invention can be used to produce an overdyed fabric of almost any color currently attainable in the trichromatic dye color system by the use of dyes, by either overdyeing a yarn made from the color pigmented fiber or by preparing the article using a lightly pigmented yarn of lighter color than the final article. The process of the invention is especially useful to make durable articles in light color shades, for example the color beige. Further, the lightly pigmented yarns may be used to produce fabrics for use in manufacturing any type of article where light fastness is desirable, including carpets and apparel.

When the fiber comprises nylon, this method of the present invention is called "Overdyeable-Solution Dyed Nylon" or OSDN. Preferable polymers include polyamides in general, and nylons in particular, including nylon 6, nylon 66, nylon 4, 6, nylon 6, 12 and blends and copoloymers thereof. It is anticipated that other polymeric fibers comprising polylactic acid, and blends and copolymers thereof, would also benefit from this invention through the incorporation of pigment into the fiber and then over-dyeing with disperse dyes either a yarn prepared from the color pigmented fiber or an article made with yarn comprising the color pigmented fiber.

The invention can also be used in conjunction with cationically dyeable fibers by first incorporating color pigments in fibers and then overdyeing with cationic ("cat") dyes. Cat dyes are usually poor in fastness and the invention will make the fiber more resistant to fading if cat dyes are used. It will also enable dyeing cationic fiber with acid, pre-met, reactive, or vat dyes including low pH dyeing where necessary and will improve the fastness properties of the dyed fiber.

A color pigment is defined as a pigment selected from one of the three families of the trichromatic dye color system (blues, yellows, reds) that can be added to a polymeric fiber in an amount effective to reduce the L* value of the fiber over a non-color pigmented fiber. Preferable color pigments are stable in light (color fast). As those well versed in the art will note, the trichromatic color system is widely practiced in the fiber dyeing industry. In this invention, the color pigments belong to this color system of blues, reds and yellows.

Suitable color pigments include but are not limited to these following color pigments, as found in the color families of the trichromatic dye system:

Reds: Pigment Red 60, Pigment Red 63, Pigment Red 80, Pigment Red 66, Pigment Red 67, Pigment Red 81, Pigment Red 68, Pigment Red 73, Pigment Red 83.

Yellows: Pigment Yellow 65, Pigment Yellow 82, Pigment Yellow 85, Pigment yellow 87.

Blues: Pigment Blue 61, Pigment Blue 69, Pigment Blue 74, Pigment Blue 78.

$TiO_2$ in the anatase or rutile forms, a white pigment, is commonly added as a delusterant to polyamide yarns. $TiO_2$ increases L* (a measure of lightness or darkness as measured by spectraphotometer) or whiteness of fiber. $TiO_2$ tends to have a deleterious effect on UV light resistance and should therefore be minimized. If $TiO_2$ is present in the fiber, and the fiber is to be dyed, the fiber should be prepared with incorporated color pigments, in an amount sufficient to overcome any deleterious effects on light fastness of the overdyed fiber owing to $TiO_2$. Those skilled in the art will be able to determine the appropriate loading of the color pigment to overcome any negative effect the $TiO_2$ may have on light fastness using testing procedures known and used today to measure light fastness, for example by measuring delta E with a spectraphotometer after Xenon arc exposure of the substrates. The total color pigment loading of about 10 ppm to about 1000 ppm, and preferably about 25 ppm to about 600 ppm, does not include the $TiO_2$ loading.

The pigmented fibers prepared thus have an L* rating from about 94 to about 70 (preferably from about 90 to about 84) so that overdyeing can be performed to achieve practically any color using standard acid dyes in the trichromatic dye color system (yellow, red, and blue dyes). The overdyeing may result in L* value being reduced by as little as 1 unit from that of the color pigmented fibers before overdyeing. The fiber color ranges from close-to-white to gray depending on the level of the color pigment used. However, the preferred color range is off-white to yellow beige or red-beige so that overdyeing can be done to achieve practically any color using the same base pigmented fiber.

Preferable results have been observed when the color pigments are selected from at least two of the families of the trichromatic dye color system, such that the total color pigment loading is about 10 to about 1000 ppm. Black pigment can optionally be added to further reduce the L* value. Suitable black pigments include but are not limited to Pigment Black 64 and Pigment Black 72. The inclusion of black pigment is to be practiced in addition to the color pigments selected from at least two of the color families of the trichromatic dye color system, and the amount of black pigment loading should be considered as part of the total color pigment loading.

It has been found that relatively small amounts of certain color pigments in polymeric fiber, and yarn made from that fiber, substantially improves the dye light fastness properties of overdyed articles made from those yarns, effectively stabilizing the dye color. For example, normally for commercial carpet, 2000 to 10000 ppm pigments are used in pigmented yarns. In the invention, the incorporation of a much lower amount of color pigment in the fiber, as low as 55 ppm total color pigment plus black pigment loading, has provided significant improvement in light fastness, as measured by delta E in a spectraphotometer after Xenon arc exposure of the overdyed substrates to a dyed fabric/carpet, acid dyed, using non-pigmented fiber.

It is possible to dye articles practically any color through over-dyeing, regardless of the color of the underlying pigmented fiber. Yarns prepared from the color pigmented yarns may be overdyed, and then incorporated into articles to provide an article of substantially uniform color. Alternatively, yarns may be prepared from the color pigmented fibers, incorporated into articles and then the article may be overdyed to a substantially uniform color. Alternatively, fabrics may be prepared from yarns comprising the color pigmented fibers, which may be overdyed and then used to manufacture articles of substantially uniform color. Inventory of raw materials may thus be reduced since practically any substantially uniform article can be prepared using a common yarn made from pigmented fiber, where the yarn has not been overdyed prior to incorporation into the article.

The process of the invention also provides for aminor reduction in dyeing costs to obtain certain colors in articles, as uniformity and depth of color is more easily achieved.

The pigments can be incorporated in the fiber in a variety of ways including: master batch concentrate addition at the throat of extruder, blending polymer/concentrate mixtures and extruding, injecting molten color concentrate/or pigments dispersed in liquid carrier in the extruder or in the polymer melt transfer line. Adequate mixers as are known in the art should be used to assure coloration uniformity.

The lightly pigmented fiber and yarn may be manufactured according to conventional melting, spinning and drawing processes known today, and using equipment commonly used today or later developed in the production of polyamide, polylactic acid and polyester fiber and yarn. Due to the low loading of pigments, the spinning process presents no additional difficulty over the spinning of non-pigmented fiber. The color pigment loadings disclosed have not exhibited adverse effects in mixing, spinning and drawing operations, as has been observed at higher pigment loading levels.

The dyes that may be used in conjunction with the invention to overdye the pigmented yarns include acid dyes, pre-metallized dyes, disperse dyes, vat dyes, cat dyes and reactive dyes. The dye processes may employ a wide range of pH during dyeing including low pH dyeing. The process of the invention may also be performed with and provide a beneficial effect to pre-metallized dyes, which are essentially acidic in nature.

The invention will be described in greater detail in conjunction with the following, non-limiting examples.

EXAMPLE 1

Test Series MR-07-03 (0.1% $TiO_2$, Acid Dyes)

995 denier yarns, in Nylon 66 polymer, were spun by adding 0.1% $TiO_2$ in the form of a masterbatch concentrate at the feed throat of a twin screw extruder. The spinning process was a standard BCF coupled process (item MR-07-03-01). Test yarns were prepared by the same process, except that additional color pigment concentrates were added at the throat of the extruder, in addition to the 0.1% $TiO_2$ as in control. Color pigment concentrations in the test fiber (MR-07-03-07A) are seen in Table 1:

TABLE 1

| Color Pigment | ppm in Fiber |
|---|---|
| Red 63 | 45 |
| Yellow 65 | 112 |
| Black 72 | 4 |
| TOTAL | 161 |

The L* value of the card winding of yarn made from the test fiber was measured to be 88.5 using a spectraphotometer.

Both yarns were made into 2 ply knit socks. The knit socks were heat set in Superba™ heat set process at 265° F. The control knit sock was dyed to a beige color using acid dyes (Yellow CGRL, Red 2B, and Blue BAR) in AHIBA™ dye baths. The test yarn knit sock was also dyed to approximately the same color, using the same dyes, but the amount of dye was adjusted such that the color of the test yarn sock substantially matched the color of the dyed control yarn knit sock. The color match was obtained by measuring the colors using a spectraphotometer and minimizing the delta E to less than 1.0.

The knit socks were then cut into smaller pieces and exposed in an ATLAS™ Xenon arc weatherometer. They were taken out after 60, 80 and 200 hours exposure and the L, a, b, values and delta E were measured using a hand held MINOLTA™ Spectraphotometer. The shift in color between the non-exposed sample and exposed sample are given below in Table 2 in terms of delta E:

TABLE 2

| Time Exposure to Xenon (Hours) | delta E MR-07-03-07A (Invention) | delta E MR-07-03-01 (Control) |
|---|---|---|
| 0 | 0.0 | 0.0 |
| 60 | 0.79 | 1.19 |
| 80 | 1.05 | 1.59 |
| 200 | 1.92 | 4.42 |

The test yarn knit sock retained its dyed color better (or delta E was much lower) over time after exposure to xenon compared to the control yarn knit sock.

EXAMPLE 2

Test Series MR-09-03 (0.3% $TiO_2$, Acid Dyes and Pre-metallized Dyes)

995 denier yarns were spun in Nylon 66 polymer by adding 0.3% $TiO_2$ in the form of a masterbatch concentrate at the feed throat of a twin screw extruder. The spinning process was a standard BCF coupled process (item MR-09-03-01). Test yarns were prepared by the same process, except that additional color pigment concentrates were added at the throat of the extruder, in addition to the 0.3% $TiO_2$ as in control. Color pigment concentrations in the test fiber (MR-09-03-03) are shown in Table 3:

TABLE 3

| Color Pigment | ppm in Fiber |
|---|---|
| Red 63 | 45 |
| Yellow 65 | 112 |
| Blue 69 | 45 |
| TOTAL | 202 |

The L* value of the card winding of yarn made from the test fiber was measured to be 89.60 using a spectraphotometer.

The yarns were made into 2 ply knit socks. The knit socks were heat set in Superba™ heat set process at 265° F. The control knit sock was dyed to a beige color using acid dyes (Yellow CGRL, Red 2B, and Blue BAR) in AHIBA™ dye baths (MR-09-03-01A). The test yarn knit sock was also dyed to approximately the same color, using the same dyes, but the amount of dye was adjusted such that the color of the test yarn sock substantially matched the color of the dyed control yarn knit sock (MR-09-03-03A). The color match was obtained by measuring the colors using a spectraphotometer and minimizing the delta E to less than 1.0.

The knit socks were then cut into smaller pieces and exposed in an ATLAS™ Xenon arc weatherometer. They were taken out after 40, 60, 80 and 200 hours exposure and the L, a, b, values and delta E were measured using a hand held MINOLTA™ Spectraphotometer. The delta E results between the non-exposed sample and exposed sample are given below in Table 4:

TABLE 4

| Time Exposure to Xenon (Hours) | delta E MR-09-03-03A (Invention) | delta E MR-09-03-01A (Control) |
|---|---|---|
| 0 | 0.0 | 0.0 |
| 40 | 0.90 | 1.47 |
| 60 | 1.82 | 1.73 |
| 80 | 2.23 | 2.66 |
| 200 | 3.10 | 4.70 |

The test yarn knit sock retained its dyed color better (or delta E was much lower) over time after exposure to xenon compared to the control yarn knit sock.

It takes less dye on the lightly pigmented fiber for test yarn knit socks to match the same dyed final color, measured by the amounts of dye used to prepare comparable beige colors in the control and the test yarn knit socks, as seen in Table 5:

TABLE 5

| Dye | Dye Amount (wt.) MR-09-03-03A (Invention) | Dye Amount (wt.) MR-09-03-01A (Control) |
|---|---|---|
| CGRL | 0.010063% | 0.010063% |
| Red 2B | 0.00025% | 0.00136% |
| BAR | 0.00025% | 0.00198% |

The experiments were repeated with pre-metallized dyes, with both the control (MR-09-03-01B) and test (MR-09-03-03B) knit socks dyed to substantially the same beige color with pre-metallized dyes after heat setting in Superba™ process at 265° F. The delta E results after Xenon exposure between the non-exposed sample and exposed sample are given below in Table 6:

TABLE 6

| Time Exposure to Xenon (Hours) | delta E MR-09-03-03B (Invention) | delta E MR-09-03-01B (Control) |
|---|---|---|
| 0 | 0.0 | 0.0 |
| 40 | 1.20 | 0.86 |
| 60 | 1.74 | 1.46 |
| 80 | 1.57 | 2.09 |
| 200 | 1.85 | 3.62 |

The invention provides extra benefit even when using pre-metallized dyes, which are well known and routinely used for their light fastness improvements in the dyeing industry, are used. This is evident after extended hours of exposure.

EXAMPLE 3

Test Series MR-08-03 (0.3% $TiO_2$, Acid Dyes, Cut Pile Carpet Continuous Range Dyed to Beige Color)

995 denier yarns of Nylon 66 with 0.3% $TiO_2$ were spun by the standard BCF coupled process (item MR-08-03-01). Test yarns were prepared by the same process, except that additional color pigment concentrates were added at the throat of the extruder. Color pigment concentrations in the test fiber (MR-08-03-22) are shown in Table 7:

TABLE 7

| Color Pigment | ppm in Fiber |
|---|---|
| Red 63 | 22 |
| Yellow 65 | 22 |
| Blue 74 | 11 |
| TOTAL | 55 |

In addition to the above color pigments, this test fiber also contained 0.3% TiO2, the same as control item MR-08-03-01. The L* value of the card winding of yarn made from this test fiber was measured to be 93.19 using a spectraphotometer.

Yarns were cable twisted to 4.5 twists per inch, heat set in Superba™ at 265° F., and tufted into cut pile carpets ⅛ gauge, ⅝" pile height, 32 OZ. The carpets were continuously dyed with acid dyes (CGRL, Red 2B, and Blue BAR) to a similar beige color. Pieces of carpet were then cut into smaller pieces and exposed in an ATLAS™ Xenon arc weatherometer. They were taken out after 40, 60, 80, 120, 160 and 200 hours exposure and the L, a, b, values and delta E were measured using a hand held MINOLTA™ Spectraphotometer. The delta E results between the non-exposed sample and exposed sample are given below in Table 8:

TABLE 8

| Time Exposure to Xenon (Hours) | delta E MR-08-03-22 (Invention) | delta E MR-08-03-01 (Control) |
|---|---|---|
| 0 | 0.0 | 0.0 |
| 40 | 1.02 | 1.75 |
| 60 | 1.77 | 2.25 |
| 80 | 2.26 | 2.83 |
| 120 | 3.46 | 4.53 |
| 160 | 4.99 | 6.47 |
| 200 | 6.18 | 6.70 |

The results show the test carpet retained its dyed color better (or delta E was lower) over time after exposure to xenon compared to the control carpet.

EXAMPLE 4

Test Series MR-10-03 (No $TiO_2$, or Bright Luster, Acid Dyes, Cut Pile Carpet Continuous Range Dyed to a Nominal Beige Color, with Black Pigment)

1205 denier bright luster yarns (0% $TiO_2$) in Nylon 66, were spun by the standard BCF coupled process (item MR-10-03-01). Test yarns were prepared by the same process, except that additional pigment concentrates were added at the throat of the extruder. Pigment concentrations in the test fiber (MR-10-03-13) are shown in Table 9:

TABLE 9

| Color Pigment | ppm in Fiber |
|---|---|
| Red 63 | 20 |
| Yellow 65 | 374 |
| Blue 74 | 76 |
| Black 72 | 24 |
| TOTAL | 494 |

The L* value of the card winding of yarn made from this test fiber was measured to be 84.26 using a spectraphotometer.

Yarns were cable twisted to 4.5 twists per inch, heat set in Superba™ at 265° F., and tufted into cut pile carpets ⅛ gauge, ⅝" pile height, 32 OZ. The carpets made of MR-10-03-13 and MR-10-03-01 yarns were continuous range dyed with_acid dyes (CGRL, Red 2B, and Blue BAR) to a similar beige color and the carpet was washed and dried. Pieces of carpet were then cut into smaller pieces and exposed in an ATLAS™ Xenon arc weatherometer. They were taken out after 40, 60, 80 and 200 hours exposure and the L, a, b, values and delta E were measured using a hand held MINOLTA™ Spectraphotometer. The delta E results between the non-exposed sample and exposed sample are given below in Table 10:

TABLE 10

| Time Exposure to Xenon (Hours) | delta E MR-10-03-13 (Invention) | delta E MR-10-03-01 (Control) |
|---|---|---|
| 0 | 0.0 | 0.0 |
| 40 | 1.33 | 2.23 |
| 60 | 1.67 | 3.38 |
| 80 | 1.45 | 5.60 |
| 200 | 2.37 | 12.38 |

The results show test carpet MR-10-03-13 retained its dyed color better (or delta E was much lower) over time after exposure to xenon compared to the control carpet MR-10-03-01.

EXAMPLE 5

Test Series MR-10-03 (No $TiO_2$, or Bright Luster, Acid Dyes, Cut Pile Carpet Continuous Range Dyed to a Nominal Medium Steel Gray Color)

1205 denier bright luster yarns (0% $TiO_2$) in Nylon 66, were spun by the standard BCF coupled process (item MR-10-03-01).

Test yarns were prepared by the same process, except that additional color pigment concentrates were added at the throat of the extruder. Color pigment concentrations in the test fiber (MR-10-03-18) are given in Table 11:

TABLE 11

| Color Pigment | ppm in Fiber |
|---|---|
| Red 63 | 12 |
| Yellow 65 | 374 |
| Blue 74 | 76 |
| TOTAL | 462 |

The L* value of the card winding of yarn made from the test yarn was measured to be 87.07 using a spectraphotometer.

Yarns were cable twisted to 4.5 twists per inch, heat set in Superba™ at 265° F., and tufted into cut pile carpets ⅛ gauge, ⅝" pile height, 32 OZ. The carpets made of MR-10-03-18 and MR-10-03-01 yarns were continuous range dyed with acid dyes (CGRL, Red 2B, and Blue BAR) to a similar medium steel gray color and the carpet was washed and dried. Pieces of carpet were then cut into smaller pieces and exposed in an ATLAS™ Xenon arc weatherometer. They were taken out after 60, 80 and 200 hours exposure and the L, a, b, values and delta E were measured using a hand held MINOLTA™ Spectraphotometer. The delta E results between the non-exposed sample and exposed sample are given below in Table 12:

TABLE 12

| Time Exposure to Xenon (Hours) | delta E MR-10-03-18 (Invention) | delta E MR-10-03-01 (Control) |
|---|---|---|
| 0 | 0.0 | 0.0 |
| 60 | 3.71 | 3.77 |
| 80 | 4.36 | 4.85 |
| 200 | 9.05 | 11.93 |

The results show test carpet MR-10-03-18 retained its dyed color better (or delta E was lower) over time after exposure to xenon compared to the control carpet MR-10-03-01.

EXAMPLE 6

Test Series MR-10-03 (No $TiO_2$, or Bright Luster, Acid Dyes, Cut Pile Carpet Continuous Range Dyed to a Nominal Beige Color)

1205 denier bright luster yarns (0% $TiO_2$), in Nylon 66, were spun by the standard BCF coupled process (item MR-10-03-01).

Test yarns were prepared by the same process, except that additional color pigment concentrates were added at the throat of the extruder. Color pigment concentrations in the test fiber (MR-10-03-18) are given in Table 13:

TABLE 13

| Color Pigment | ppm in Fiber |
|---|---|
| Red 63 | 12 |
| Yellow 65 | 374 |
| Blue 74 | 76 |
| TOTAL | 462 |

The L* value of the card winding of this yarn made from the test fiber was measured to be 87.07 using a spectraphotometer.

Another test yarn (MR-10-03-11) was prepared by the same process, except that additional color pigment concentrates were added at the throat of the extruder to make the final fiber color close to the final dyed colors of items MR-10-03-01 and MR-10-03-18. This item (MR-10-03-11) was not dyed. Pigment concentrations in the test fiber (MR-10-03-11) are given in Table 14:

TABLE 14

| Color Pigment | ppm in Fiber |
|---|---|
| Red 63 | 40 |
| Yellow 65 | 500 |
| Blue 74 | 76 |
| Black 72 | 24 |
| TOTAL | 640 |

The L* value of the card winding of this yarn was measured to be 84.14 using a spectraphotometer.

Yarns were cable twisted to 4.5 twists per inch, heat set in Superba™ at 265° F., and tufted into cut pile carpets ⅛ gauge, ⅝" pile height, 32 OZ. The carpets made of MR-10-03-18 and MR-10-03-01 yarns were continuous range dyed with acid dyes (CGRL, Red 2B, and Blue BAR) to a similar beige color and the carpet was washed and dried. Carpet made of MR-10-03-11 was not dyed or treated in anyway. Pieces of carpet were then cut into smaller pieces and exposed in an ATLAS™ Xenon arc weatherometer. They were taken out after 40, 60, 80 and 200 hours exposure and the L, a, b, values and delta E were measured using a hand held MINOLTA™ Spectrophotometer. The delta E results are given below in Table 15:

TABLE 15

| Time Exposure to Xenon (Hours) | delta E MR-10-03-18 (Invention) | delta E MR-10-03-01 (Control) | delta E MR-10-03-11 (No Dye) |
|---|---|---|---|
| 0 | 0.0 | 0.0 | 0.0 |
| 40 | 2.15 | 2.23 | 0.40 |
| 60 | 2.77 | 3.38 | 0.77 |
| 80 | 3.45 | 5.60 | 1.32 |
| 200 | 5.74 | 12.38 | 1.52 |

The results show test carpet MR-10-03-18 retained its dyed color better (or delta E was much lower) over time after exposure to xenon compared to the control carpet MR-10-03-01. Carpet MR-10-03-11 made only with pigments but undyed showed the best performance.

The foregoing examples have been presented for the purpose of illustration and description only and are not to be construed as limiting the scope of the invention in any way. The scope of the invention is to be determined from the claims appended hereto.

What is claimed is:

1. A polymeric lightly pigmented overdyed fiber, consisting of:

a polymer;

color pigments, wherein the color pigments are selected from two of the color families of the trichromatic dye color system, the trichromatic dye color system consisting of blue, yellow and red, the pigmented fiber having off-white color with L* value of about 70 to about 94, wherein the color pigments consist of a combination of two of Pigment Red 60, Pigment Red 63, Pigment Red 80, Pigment Red 66, Pigment Red 67, Pigment Red 81, Pigment Red 68, Pigment Red 73, Pigment Red 83, Pigment Yellow 65, Pigment Yellow 82, Pigment Yellow 85, Pigment Yellow 87, Pigment Blue 61, Pigment Blue 69, Pigment Blue 74, and Pigment Blue 78;

a dye appropriate for the polymer;

optionally $TiO_2$ delusterant; and wherein the total pigment loading level is in the range from about 10 to about 600 ppm by weight of the fiber.

2. The fiber of claim 1, wherein the polymer is selected from the group consisting of polylactic acid, polyamide, and copolymers and blends thereof.

3. The fiber of claim 2, wherein the polyamide is nylon.

4. The fiber of claim 3, wherein the nylon is nylon 6, nylon 66, nylon 4, 6, nylon 6, 12, and blends and copolymers thereof.

5. The fiber of claim 3, wherein the nylon is cationically dyeable nylon polymers.

6. The fiber of claim 1, wherein the dye consists of at least one of acid dye, pre-metallized dye, disperse dye, vat dye, cationic dye and reactive dye.

7. The fiber of claim 1, wherein the color pigments consist of at least two of Pigment Red 63, Pigment Blue 74, Pigment Blue 69 and Pigment Yellow 65.

8. A uniformly overdyed article comprising a substantially homogeneous yarn, the yarn consisting essentially of the fiber of claim 1.

9. The overdyed article of claim 8, wherein the overdyed article comprises one of an article of apparel or a carpet.

* * * * *